US005338221A

United States Patent [19]

Bowen et al.

[11] Patent Number: 5,338,221

[45] Date of Patent: Aug. 16, 1994

[54] ELECTRICAL CONNECTOR FOR HIGH DENSITY RIBBON CABLE

[75] Inventors: David C. Bowen, Downers Grove; Jerry A. Long, Elgin, both of Ill.

[73] Assignee: Molex Incorporated, Lisle, Ill.

[21] Appl. No.: 74,177

[22] Filed: Jun. 9, 1993

[51] Int. Cl.[5] ..... H01R 4/24

[52] U.S. Cl. ..... 439/405

[58] Field of Search ..... 439/405, 404, 417, 460, 439/468, 470, 473

[56] References Cited

U.S. PATENT DOCUMENTS

| | | | |
|---|---|---|---|
| 4,101,189 | 7/1978 | Moser et al. | 439/405 |
| 4,262,984 | 4/1981 | Takahashi | 439/405 |
| 4,902,242 | 2/1990 | Davis et al. | 439/404 |
| 4,948,381 | 8/1990 | Saito et al. | 439/405 |
| 4,950,177 | 8/1990 | Szczesny | 439/404 |
| 5,118,306 | 6/1992 | Bixler et al. | 439/405 |
| 5,122,079 | 6/1992 | Locati | 439/417 |
| 5,123,859 | 6/1992 | Davis et al. | 439/405 |
| 5,178,558 | 1/1993 | Knox et al. | 439/404 |

*Primary Examiner*—Gary F. Paumen
*Attorney, Agent, or Firm*—A. A. Tirva

[57] ABSTRACT

An electrical connector is provided for insulation displacing termination of ribbon cable having conductors in predetermined close centerline spacing. The connector includes a dielectric housing having a mating face, an opposed cable-receiving face and a plurality of terminal-receiving passages extending between the faces for receiving a plurality of terminals. Each terminal includes a mating portion toward the mating face and slotted U-shaped insulation displacement portion toward the cable-receiving face. The insulation displacement portions of the terminals are arranged staggered in at least two rows. A dielectric cover forces the conductors into the U-shaped insulation displacement portions and embraces the cable between the cover and the cable-receiving face of the housing. The cover includes a surface for engaging the cable and holes in the surface for receiving the U-shaped insulation displacement portions of the terminals. Recessed areas are provided adjacent the holes in the cover which receive the insulation displacement portions of the terminals. Therefore, the conductors on opposite sides of any given conductor being terminated can float into the recessed areas as a respective insulation displacement portion is forced into termination with the given conductor.

5 Claims, 5 Drawing Sheets

ELECTRICAL CONNECTOR FOR HIGH DENSITY RIBBON CABLE

FIELD OF THE INVENTION

This invention generally relates to the art of electrical connectors and, particularly, to an electrical connector assembly for terminating a multi-conductor flat cable such as a ribbon cable.

BACKGROUND OF THE INVENTION

Electrical connectors have been provided in a wide variety of configurations for terminating multiconductor cables such as integral flat or ribbon cables. With the ever-increasing miniaturization of electrical connectors and the ever-increasing numbers of wires in multi-conductor cables, electrical connectors of the character described have become increasingly complicated in order to accommodate relatively large numbers of conductors terminated in relatively small connectors. For instance, a ribbon cable may have conductors on close centerline spacing on the order of 25 mils. Connectors for such high density ribbon cables are used in a variety of applications, such as installing disk drives in small computers.

Most electrical connectors for terminating ribbon cables are of the insulation displacing termination type. These connectors generally include a housing having a mating face, an opposed cable-receiving face, and at least two rows of terminal-receiving passages extending between the faces. A plurality of terminals, most often stamped and formed of sheet metal material, are received in respective passages, each terminal having a mating portion toward the mating face of the housing and a generally U-shaped insulation displacement portion toward the cable-receiving face of the housing. Some form of secondary housing component, such as a cover, is provided for forcing conductors of the ribbon cable into the U-shaped insulation displacement portions of the terminals, with the cover embracing the ribbon cable between the cover and the cable-receiving face of the housing.

One of the problems with connectors of the character described immediately above, centers around the high density of the conductors in the ribbon cable. Because of the close spacing of the conductors, the insulation displacement portions of the terminals are arranged in two generally spaced-apart staggered rows with adjacent terminals located in opposite rows. Therefore, a conductor to be terminated in an insulation displacement portion located in a back row will necessarily have to pass between two insulation displacement portions located in a front row. Such close spacing may create problems and may result in shorting, especially since the narrow insulation displacement beams of a terminal present a low normal force on a given conductor which requires pushing the conductor further into the U-shaped insulation displacement portion of the terminal. This may result in substantial lateral movement of the beams forming the U-shaped insulation displacement portion, forcing the beams into the insulation of conductors adjacent to the terminated conductor. One solution to this particular problem is to utilize the so-called "hill and dale" system which locates portions of the conductors at the insulation displacement sections of adjacent terminals in different vertical positions or levels. However, molding the connector components for effecting this approach is rather complicated and expensive.

The present invention is directed to solving the problems identified above by providing an extremely simple solution whereby areas of the cover which forces the cable against the cable-receiving face of the housing and the conductors into the insulation displacement portions of the terminals, are recessed about the insulation displacement portions. This allows adjacent conductors on opposite sides of any given conductor which is being terminated to float into the recessed areas so that the beams of the insulation displacement portions are not forced into the adjacent conductors.

SUMMARY OF THE INVENTION

An object, therefore, of the invention is to provide a new and improved insulation displacement connector assembly for high density ribbon cable.

In the exemplary embodiment of the invention, an electrical connector is disclosed for insulation displacing termination of ribbon cable having conductors on predetermined close centerline spacing. The connector includes a housing having a mating face, an opposed cable-receiving face and a plurality of terminal-receiving passages extending between the faces. A plurality of terminals are received in the passages. Each terminal includes a mating portion toward the mating face of the housing and a slotted U-shaped insulation displacement portion toward the cable-receiving face of the housing. The insulation displacement portions of the terminals are arranged staggered in at least two rows. A dielectric cover is provided for forcing the conductors into the U-shaped insulation displacement portions and embracing the cable between the cover and the cable-receiving face of the housing. The cover includes surface means for engaging the cable and holes in the surface means for receiving the U-shaped insulation displacement portions of the terminals.

The invention contemplates the provision of recess means in the surface means of the cover in areas adjacent the holes which receive the insulation displacement portions of the terminals. Therefore, the conductors on opposite sides of any given conductor being terminated can float into the recessed areas as an insulation displacement portion of a respective terminal is forced into termination with the given conductor.

As disclosed herein, the surface means of the cover include a plurality of closely spaced, side-by-side troughs for registering with the conductors of the ribbon cable. The housing and the cover are elongated, and the troughs extend transverse to the elongated direction thereof. The holes in the cover and the insulation displacement portions of the terminals are arranged in two pairs of two rows lengthwise of the cover and housing. The holes and insulation displacement portions are staggered in the rows of each pair thereof. The holes and insulation displacement portions in each pair of rows are spaced on the order of 50 mils. The troughs, themselves, are spaced on the order of 25 mils to accommodate a 25 mil conductor centerline spacing of the ribbon cable. The troughs which intersect one row of holes in each pair of rows extend from a longitudinal edge of the cover. The troughs which intersect the other row of holes in each pair of rows extend from a transverse mid-point of the elongated cover. Each trough extends into the recess means only slightly beyond one edge of the respective hole which the trough intersects.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
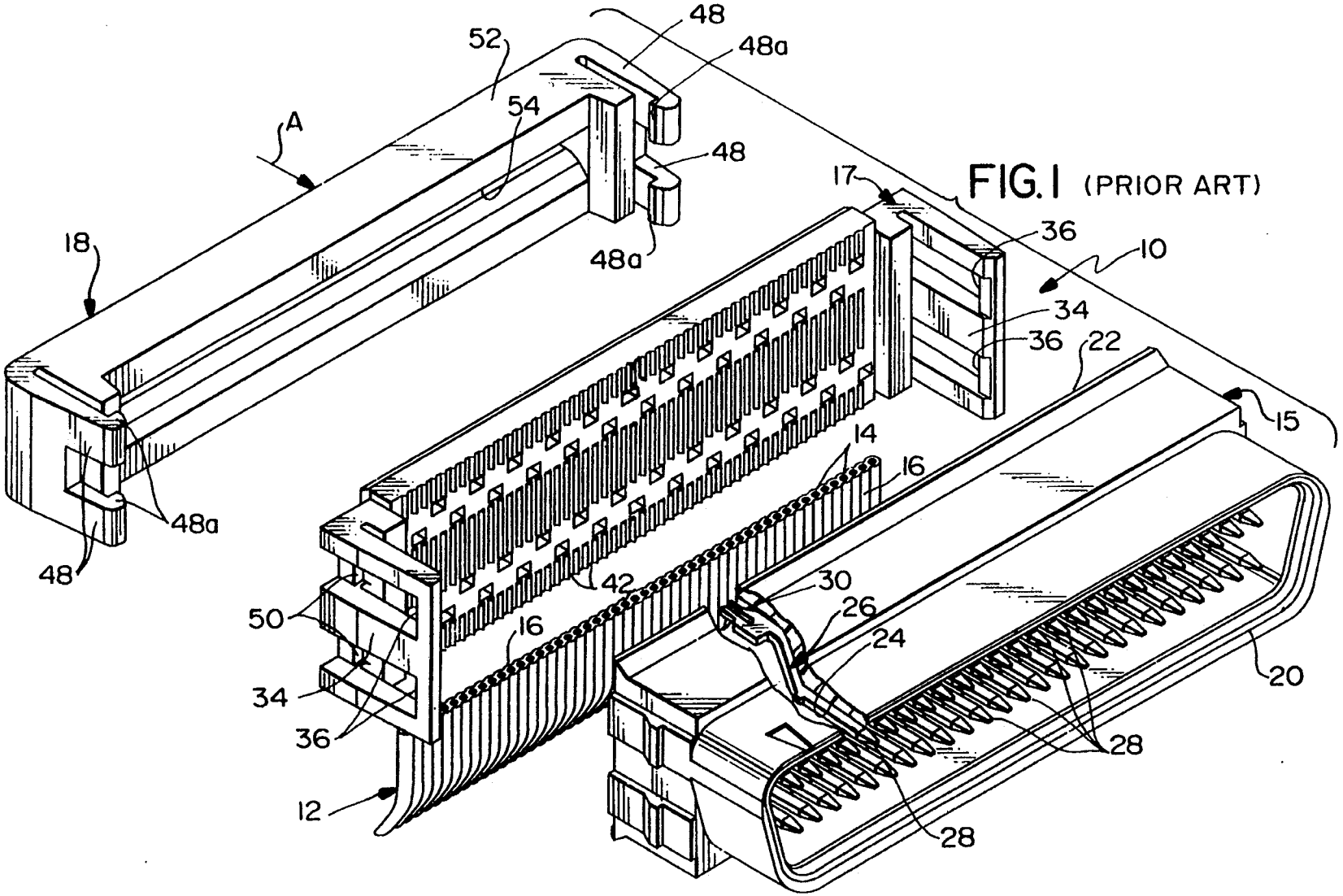
FIG. 1 (PRIOR ART)
FIG. 1 is an exploded perspective view of an electrical connector assembly of the prior art, for insulation displacement termination of a ribbon cable.

Referring to the drawings in greater detail, and first to FIG. 1, an electrical connector assembly of the prior art, generally designated 10, is shown for insulation displacing termination of a ribbon cable, generally designated 12. The ribbon cable is of a conventional configuration and has a plurality of conductors 14 on predetermined close centerline spacing. The conductors are surrounded by insulation which also integrally joins adjacent conductors, as is well known in the art. Therefore, opposite faces 16 of the integral flat ribbon cable are undulated transversely of the cable.

Prior art connector 10 includes a housing, generally designated 15; a cover, generally designated 17; and a strain relief member, generally designated 18. All of these three connector components are elongated transversely of ribbon cable 12 as is shown in the drawings. Housing 15 includes a mating face 20, an opposed cable-receiving face 22 and a plurality of terminal-receiving passages 24 extending between the faces. A plurality of terminals, generally designated 26, are received in passages 24. Each terminal includes a mating portion or pin 28 toward mating face 20 of housing 15 and a slotted U-shaped insulation displacement portion 30 toward cable-receiving face 22. As will be more clearly envisioned below, insulation displacement portions 30 are arranged staggered in two pairs of two rows longitudinally of housing 15 and connector assembly 10.

Cover 17 is unitarily molded of dielectric material, such as plastic or the like, and includes an elongated, generally flat body portion 32 having resilient latch arms 34 at opposite ends thereof. The latch arms have openings 36 which snap over latch bosses 38 at opposite ends of housing 15. Generally, cover 17 is provided for forcing conductors 14 of ribbon cable 12 into the U-shaped insulation displacement portions 30 of terminals 26 and embracing the cable between the cover and cable-receiving face 22 of the housing. More particularly, the cover includes an inner flat surface 40 for engaging the cable. A plurality of troughs 42 along opposite edges of surface 40 and a plurality of troughs 44 along the center of surface 40 are provided for registering with the conductors of the ribbon cable. In essence, the troughs match the undulated sides 16 of the ribbon cable.

It can be seen in FIG. 1 that the bottoms of troughs 42 and 44 are flush with or form continuations of flat surface 40 of the cover. Two pairs of two rows of holes 46 are provided in flat surface 40 of the cover for receiving the U-shaped insulation displacement portions 30 of terminals 26. The holes may extend completely through body portion 32 of the cover, but, conventionally, the holes are just deep enough to accommodate the insulation displacement portions of the terminals as the insulation displacement portions pierce through the ribbon cable. It can be seen that the holes in each pair of two rows are arranged staggered in each pair of rows. If conductors 14 are on 25 mil centerline spacing, the holes in the two rows of each pair are spaced on the order of 50 mils. In operation, as cover 17 is used to force conductors 14 of ribbon cable 12 into insulation displacement portions 30 of terminals 26. The undulated surface of the ribbon cable sort of seats into troughs 42 and 44 which, thereby, aligns or registers the conductors with holes 46 and the insulation displacement portions of the terminals. With the cable embraced between surface 40 of the cover and cable-receiving face 22 of the housing, forcing the cover into a fully latched position on the housing effects insulation displacement termination of all of the terminals with all of the conductors of the ribbon cable.

Strain relief member 18 also is a unitarily molded component of dielectric material, such as plastic or the like, and has a pair of latch arms 48 at opposite ends thereof, with the latch arms having inwardly directed hook portions **48*a*. The hook portions snappingly engage over shoulders 50 at opposite ends of cover 17. The strain relief member has an elongated body portion 52 provided with a longitudinally extending slot 54 completely through the cover. In assembly, ribbon cable 12 is inserted through slot 54 in the direction of arrow "A" and the cable then is wrapped around one edge of body portion 32 of cover 17 so that a trimmed end of the cable can be positioned against surface 40 of the cover. Therefore, the cable is assembled in a sort of serpentine configuration through slot 54 in strain relief member 18 and about body portion 32 of cover 17, whereupon the strain relief member clamps the cable against a back side 56** of the cover when the strain relief member is clampingly latched to the cover.

Figure 2:
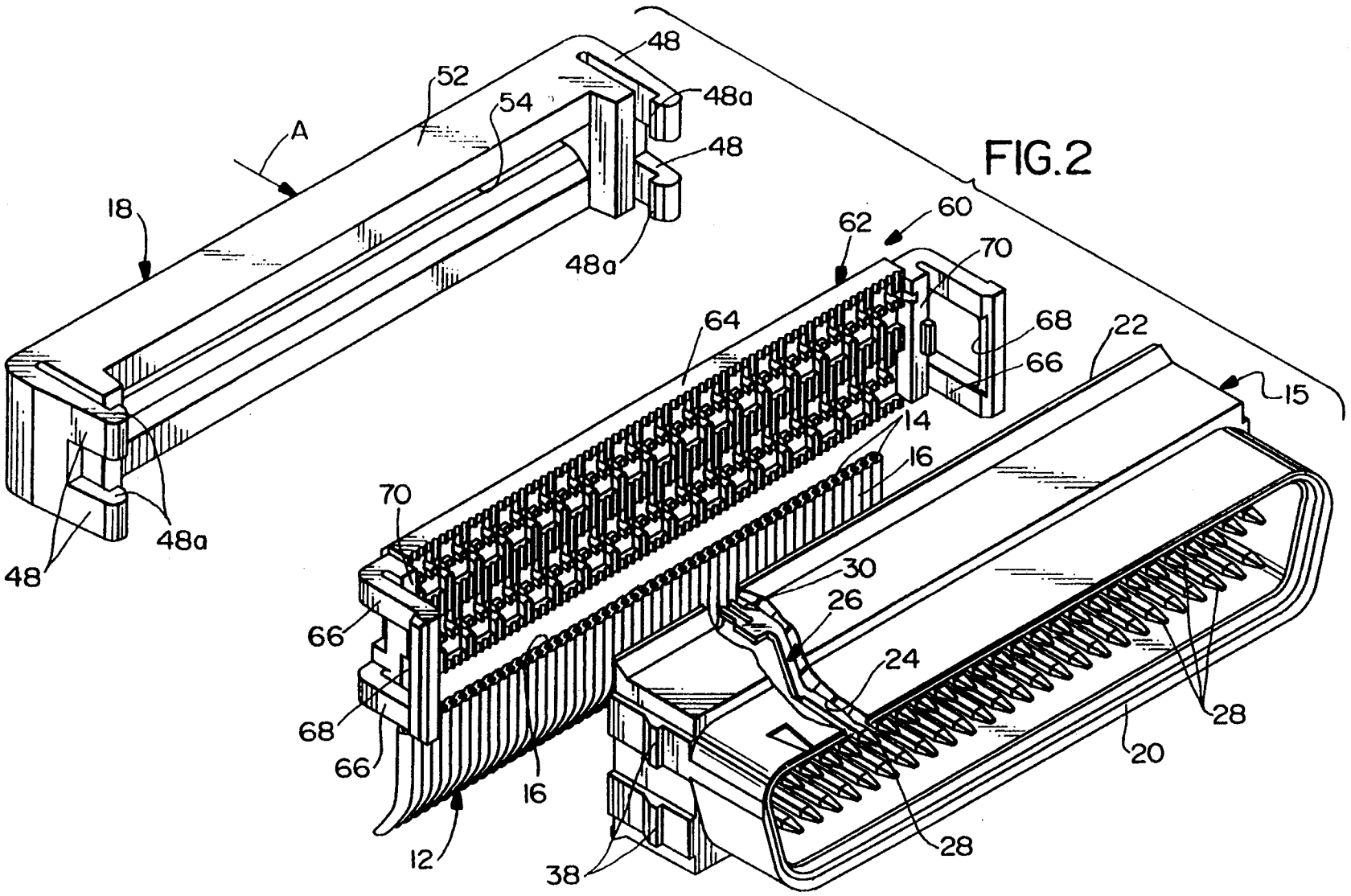
FIG. 2 is an exploded perspective view of the connector assembly of the invention.

FIG. 2 shows an electrical connector, generally designated 60, embodying the concepts of the invention. Ribbon cable 12, housing 15 and strain relief member 18 of connector 60 are identical to those components of prior art connector assembly 10 described above and shown in FIG. 1. Therefore, the details of the ribbon cable, housing and strain relief member will not be repeated, and like reference numerals have been applied in FIG. 2 corresponding to like items described in relation to FIG. 1.

Connector 60 of the invention includes a cover, generally designated 62, having an elongated body 64 with flexible latch arms 66 at opposite ends thereof. The latch arms have openings 68 for latchingly engaging latch bosses 38 of housing 15. Hook portions **48*a* of latch arms 48 of strain relief member 18 latchingly engage shoulders or surfaces 70** at opposite ends of the cover.

Figure 3:
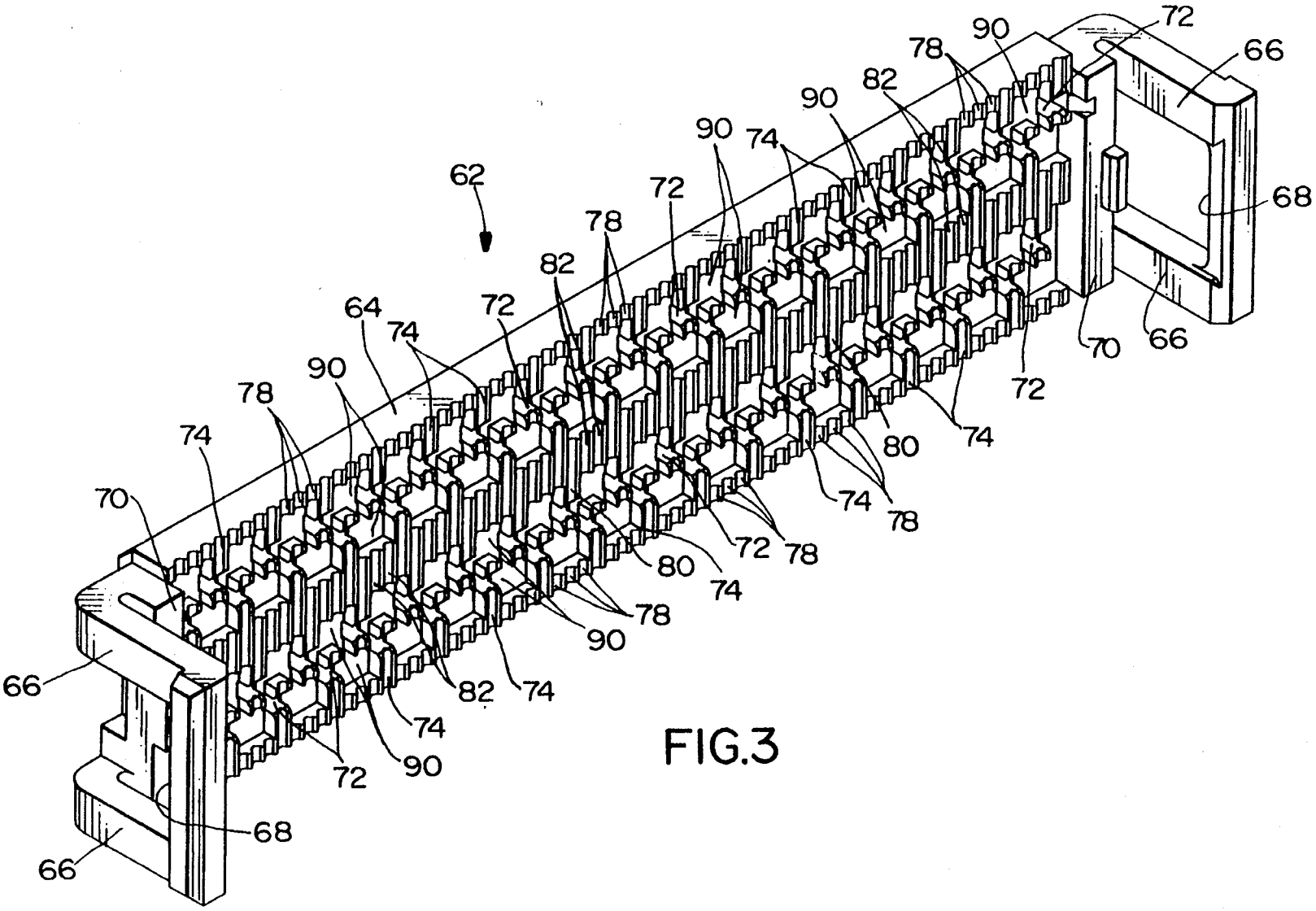
FIG. 3 is a perspective view, on an enlarged scale, of the cover of the connector of the invention.
Figure 4:
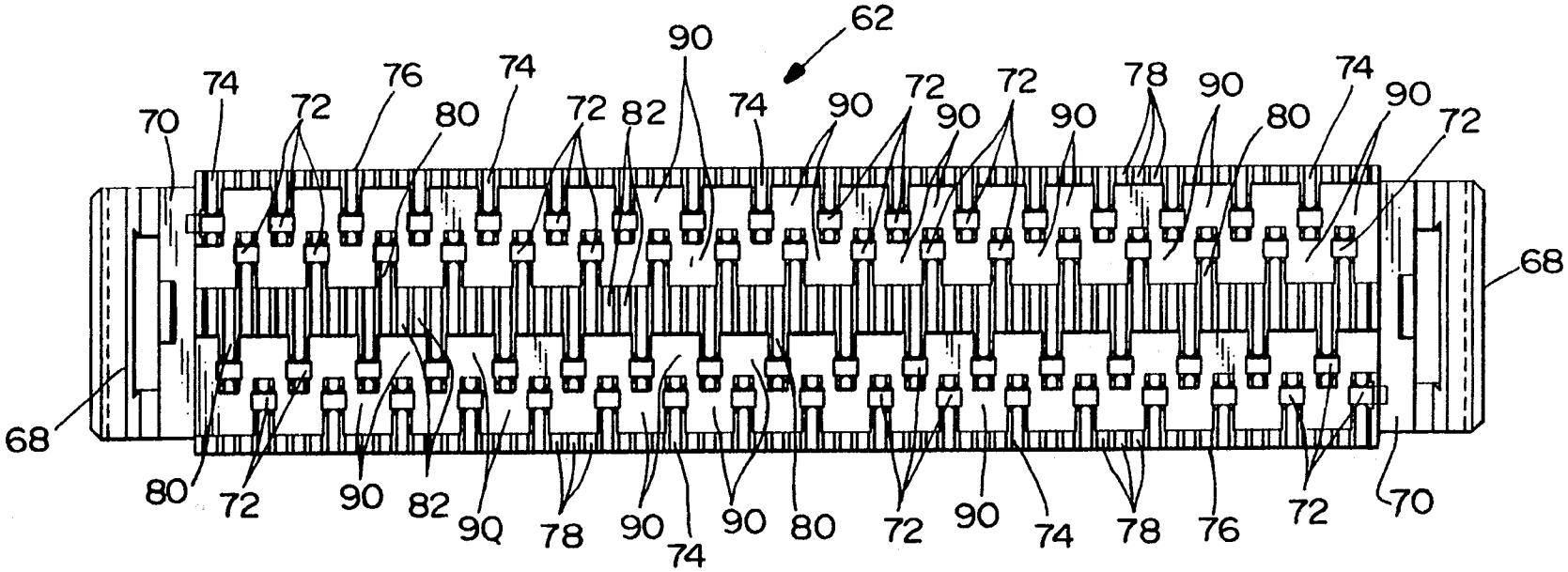
FIG. 4 is an elevational view of the inside of the cover shown in FIG. 3.
Figure 5:
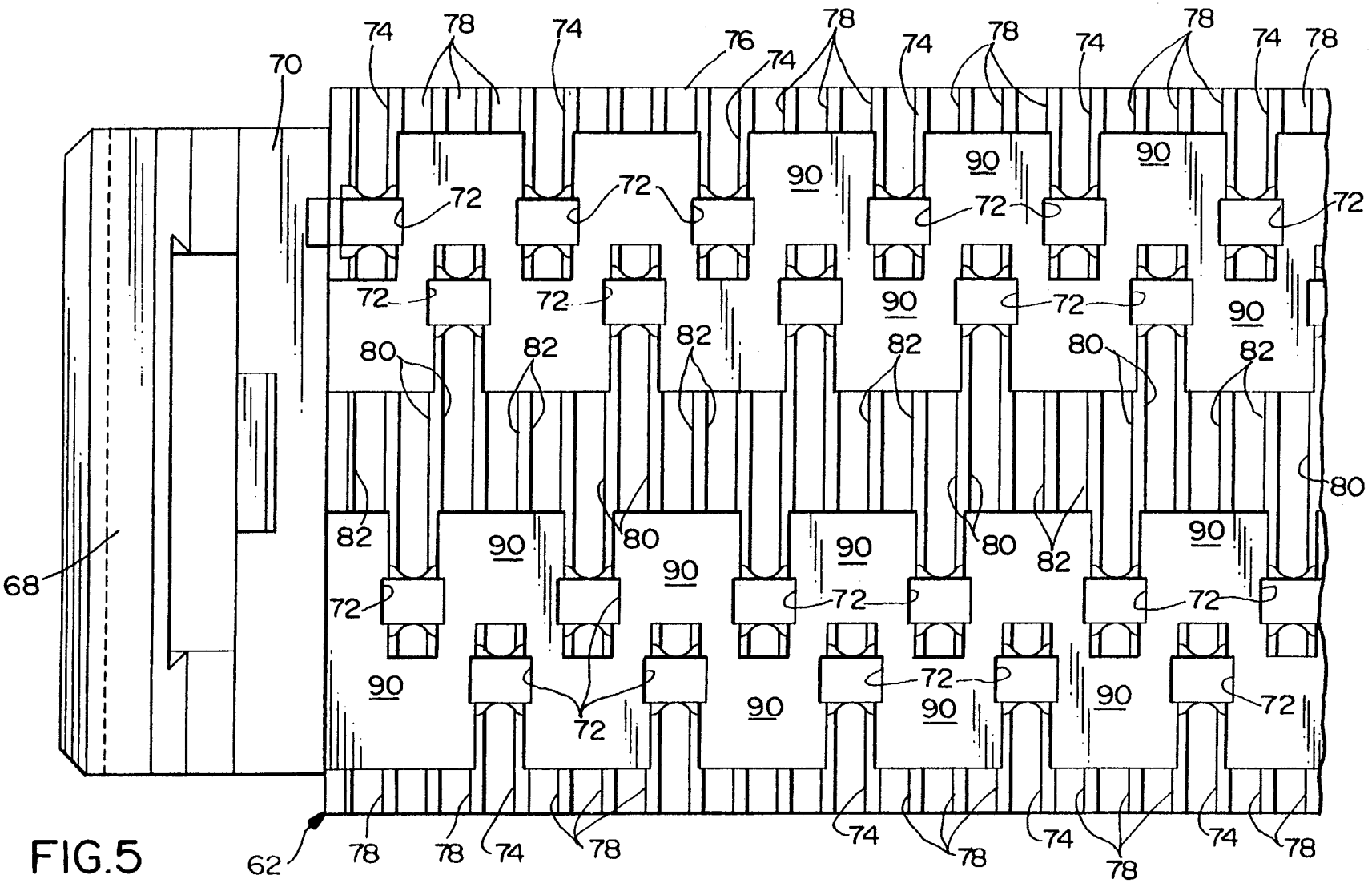
FIG. 5 is a fragmented view of the left-hand end of the cover in FIG. 4, on a further enlarged scale to facilitate the illustration.

Referring to FIGS. 3–5 in conjunction with FIG. 2, cover 62 includes a plurality of holes 72 which receive insulation displacement portions 30 of terminals 26 in the same manner and for the same purposes as described above in relation to holes 40 of cover 16 (FIG. 1). Similarly, holes 72 can extend all the way through body portion 64 of cover 62, but preferably the holes are just deep enough to accommodate the insulation displacement portions of the terminals. Also, comparing FIGS. 2–5 with FIG. 1, it can be seen that holes 72 similarly are arranged in two pairs of two rows longitudinally of the cover/connector. The holes are arranged staggered in the two rows of each pair thereof. The staggered holes in each pair of two rows are spaced longitudinally of the cover/connector on the order of 50 mils.

Generally, cover 62 includes trough means on the inside thereof similar in function to troughs 42 and 44 of cover 17 (FIG. 1), in that the trough means of cover 62 are effective to engage the undulated surface of ribbon cable 12 and effectively align or register the conductors of the cable with holes 72 and the insulation displacement portions of the terminals. However, the trough means of cover 62 can best be seen in the enlarged depiction in FIG. 5, to include primary troughs 74 projecting inwardly from opposite edges 76 of the body portion of the cover. Each primary trough 74 intersects a hole 72 which receives a respective one of the terminal insulation displacement portions. Secondary trough sections 78 are located along each edge 76 between primary troughs 74.

Another array of troughs and trough sections extend in a side-by-side arrangement lengthwise of the cover down the middle thereof. More particularly, a plurality of primary troughs 80 project outwardly from a midpoint of the cover and each primary trough 80 intersects a respective one of holes 72 which receive the insulation displacement portions of the terminals. Secondary trough sections 82 are located between primary trough sections 80.

Therefore, it can be envisioned that trough means are provided substantially along the entire length of the inside of cover 62 on 25 mil centerline spacing corresponding to the conductor spacing of the ribbon cable. For instance, each primary trough 74 along one edge of the cover also is aligned with a center secondary trough section 82 and a secondary trough section 78 on the opposite edge of the cover. Each center primary trough 80 is aligned or registered with a secondary trough 78 at each edge of the cover. Lastly, it can be seen that each edge primary trough 74 and each center primary trough 80 extends through and slightly beyond its respective hole 72 for receiving one of the insulation displacement portions of the terminals.

In contrast to the flat surface 40 on the inside of prior art cover 17 (FIG. 1) which is flush with the bottoms of troughs 42 and 44, cover 62 of the invention includes recess means in the form of recessed areas 90 adjacent holes 72 which receive the insulation displacement portions of the terminals. In essence, these recessed areas 90 lie "below" the bottoms of troughs 74 and 80 and the bottoms of trough sections 78 and 82. When a ribbon cable is embraced against the inside of cover 62, with the undulated surface of one side of the ribbon cable seated in troughs 74 and 80 and trough sections 78 and 82, an open space is provided beneath the ribbon cable in all of the recessed areas identified at 90 in the drawings, particularly as seen in FIGS. 3–5.

In operation, with recessed areas 90 being located adjacent holes 72, particularly on opposite sides of the holes as seen in the drawings, the conductors on opposite sides of any given conductor which is being terminated can float into these recessed areas as a respective insulation displacement portion is forced into the respective hole 72 and into termination with the given conductor. As a result, there is no rigid backing behind the adjacent "non-terminating" conductors as is present by surface 40 on the inside of cover 17 of the prior art in FIG. 1. The beams of the U-shaped insulation displacement portions of the terminals, therefore, are not prone to cut into the insulation of the adjacent conductors because those conductors float or "give" in a yielding manner into recessed areas 90.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an electrical connector for insulation displacing termination of ribbon cable having conductors on predetermined close centerline spacing, including a dielectric housing having a mating face, an opposed cable-receiving face and a plurality of terminal-receiving passages extending between the faces, a plurality of terminals received in the passages, each terminal including a mating portion toward said mating face and a slotted U-shaped insulation displacement portion toward the cable-receiving face, the insulation displacement portions of the terminals being arranged staggered in at leas two rows, and a dielectric cover for forcing the conductors into the U-shaped insulation displacement portions and embracing the cable between the cover and the cable-receiving face of the housing, the cover including surface means including a plurality of closely spaced: side-by-side troughs for registering with the conductors of said ribbon cable for engaging the cable and holes in the surface means for receiving the U-shaped insulation displacement portions of the terminals, wherein at least some of the troughs intersect said holes in the cover, wherein the improvement comprises:

recess means in the surface means of the cover in areas adjacent the holes which receive the insulation displacement portions of the terminals, whereby the conductors on opposite sides of any given conductor being terminated can float into said areas as a respective insulation displacement portion is forced into termination with the given conductor, and wherein at least some of the troughs extend into recess means only slightly beyond one edge of the respective hole which the respective trough intersects.

2. In an electrical connector as set forth in claim 1, wherein said troughs are spaced on the order of 25 mils to accommodate a 25 rail conductor centerline spacing of the ribbon cable.

3. In an electrical connector for insulation displacing termination of a ribbon cable having conductors on predetermined close center line spacing, including a housing mounting a plurality of terminals having insulation-displacement portions, and a cover for forcing the conductors into the insulation displacement portions and embracing the cable between the cover and the housing, the cover including troughs for registering with the conductors of the ribbon cable, wherein the improvement comprises:

recess means in the cover in areas on opposite sides of the troughs where the insulation displacement portions of the terminals engage the conductors of the cable, the recess means providing areas into which conductors on opposite sides of any given conductor, being terminated can float as a respective insulation displacement portion is forced into termination with the given conductor, and wherein at least some of the troughs extend into said recess means only slightly beyond one edge of the respective hole which the respective trough intersects.

4. In an electrical connector as set forth in claim 3, wherein said troughs are spaced on the order of 25 mils to accommodate a 25 mil conductor centerline spacing of the ribbon cable.

5. In an electrical connector as set forth in claim 3, wherein the cover includes holes for receiving the insulation displacement portions of the terminals, and said recess means are in areas adjacent opposite sides of the holes.

* * * * *